United States Patent [19]

Celant et al.

[11] Patent Number: 4,608,269

[45] Date of Patent: Aug. 26, 1986

[54] ELECTROSTATIC STRIPING OF THREE-PART METAL-CAN SEAMS

[75] Inventors: Jean J. Celant, 20, route de Ste-Cecile, Serignan Du Cantat (Vaucluse); Francois Bochaton, Cluny, both of France

[73] Assignees: W.C.C.E. World Can and Cap Engineering, Macon; Jean Jacques Celant, Serignan Du Cantat, both of France

[21] Appl. No.: 681,496

[22] Filed: Dec. 13, 1984

[30] Foreign Application Priority Data

Dec. 15, 1983 [FR] France ..... 83 20419

[51] Int. Cl.[4] ..... B05B 5/02; B05B 7/14; B65D 8/22

[52] U.S. Cl. ..... 427/28; 427/27; 427/29; 427/32; 427/33; 118/621; 118/629; 118/622

[58] Field of Search ..... 427/27, 28, 29, 32, 427/33; 118/621, 629, 622

[56] References Cited

U.S. PATENT DOCUMENTS

| | | | |
|---|---|---|---|
| 4,205,621 | 6/1980 | Payne | 188/622 |
| 4,212,266 | 7/1980 | Payne | 118/622 |
| 4,215,648 | 8/1980 | Stamets | 427/28 |

*Primary Examiner*—Richard Bueker

*Attorney, Agent, or Firm*—Karl F. Ross; Herbert Dubno

[57] ABSTRACT

The inside of a sleeve is positioned over a nozzle having an elongated groove opening immediately at the region of the sleeve to be striped. The sleeve surrounding the nozzle is given a predetermined potential level. A stream of particles is introduced into at least one end of the groove in a direction at least generally parallel to the groove and to the region to be striped. The particles are charged relative to the potential level of the sleeve such that the particles are attracted to the sleeve. A stream of air is also introduced under pressure into the opposite end of the groove in generally the opposite direction. The countercurrent thus produced deflects the stream of powder so it projects generally radially from the nozzle groove, thickly coating the strip region at the seam. The region is the seam of the sleeve which is to be made into a three-part can, in which case the groove is longer than the sleeve.

14 Claims, 8 Drawing Figures

ELECTROSTATIC STRIPING OF THREE-PART METAL-CAN SEAMS

FIELD OF THE INVENTION

The present invention relates to the manufacture of a three-part metal can. More particularly this invention concerns the striping of the soldered seam of such a can made of electrically welded tin plate.

BACKGROUND OF THE INVENTION

A standard three-part can of the type used to package food is made of a normally cylindrical sleeve and two end caps. The sleeve is manufactured from a rectangular blank of tin plate, that is thin sheet iron or steel coated with tin, that is rolled up with its ends overlapping, and then these ends are seamed together. It is also standard to coat the inside at least of the can with an organic varnish that separates the metallic tin coating from the can's contents, something that is particularly necessary with foodstuffs. This varnish coating is not done at the seam, since it is necessary to get good direct metal-to-metal contact at the overlapping ends that are fastened together to form this seam.

As metallic tin is very expensive it is invariably alloyed with lead to use as solder in making the sleeve seam. Lead is a poison so that it is necessary to coat this seam to separate it from any foodstuffs in the resultant can, even in cans where only a tiny amount of the solder is used at a folded-over seam. Hence a procedure has developed of electric welding the seam of the sleeve, a process which also can leave some of the lead-containing solder exposed on the inside of the sleeve. Recourse is hence had to an organic varnish coating on this seam once it is formed, a process known as striping.

Spraying the coating on often results in a coating that is too thin and like all such spraying operations releases solvent that cannot be left on the product and that must be removed from the site and kept away from the workers. Simply brushing or rolling on the varnish again produces a coating that is too thin, even when several passes are made, and also requires the use of a liquid solvent with the attendant problems. Electrostatically applying the coating has the advantage of being able to produce a thick coating at the exact region that is uncoated, but this process is extremely hard to control. Thus in the food industry where quality control is very strict such a process cannot be used.

OBJECTS OF THE INVENTION

It is therefore an object of the present invention to provide an improved method of and apparatus for electrostatically striping a can sleeve.

Another object is the provision of such an electrostatic striping system which overcomes the above-given disadvantages, that is which produces sure and accurate results.

SUMMARY OF THE INVENTION

The inside of a sleeve is positioned over a nozzle having an elongated groove opening immediately at the region of the sleeve to be striped. The sleeve surrounding the nozzle is given a predetermined potential level. A stream of particles is introduced into at least one end of the groove in a direction at least generally parallel to the groove and to the region to be striped. The particles are charged relative to the potential level of the sleeve such that the particles are attracted to the sleeve. A stream of air is also introduced according to this invention under pressure into the opposite end of the groove in generally the opposite direction.

The countercurrent thus produced deflects the stream of powder so it projects generally radially from the nozzle groove, perfectly and thickly coating the strip region at the seam. Such an arrangement therefore can form a perfectly neat and thick stripe, without the generation of noxious solvent vapors and in a manner assuring the particles will only go to the uninsulated surface portions and will coat only until the thickness of particles is too great to permit further particles to adhere electrostatically. The procedure is particularly effective when the region is the seam of the sleeve which is to be made into a three-part can, in which case the groove is longer than the sleeve.

According to this invention the particles mixed with air under pressure are injected as opposite streams into the opposite ends of the groove. It is also within the scope of this invention for substantially only particles to be injected into the one end of the groove and substantially only air under pressure into the other end of the groove. The particles are injected into the one end of the groove substantially parallel to the groove and region and the compressed air is introduced into the other end of the groove at a slight acute angle to the groove and region, angled back away from the surface being striped. This gives a purely aerodynamic effect.

In accordance with another feature of this invention the sleeve is imparted a predetermined potential level by grounding it. The particles and compressed air can be introduced mixed together into the opposite ends of the grooves as opposite streams and the particles of the one stream are charged positive and the particles of the other stream negative. The volume/time rate of flow of the two groove ends can be the same or different. Independent controls can be provided well upstream of the nozzle to tailor the longitudinal spillover of the flow to compensate, for example, for a moving target.

This potential difference can be achieved in several ways. A high-voltage (15 kV to 100 kV) current is needed. It could be fed by appropriate cables from an external power supply. An oscillator-type generator working at low voltage (12 v, 17 kHz) could be connected by a low-voltage cable to a cascade or autotransformer in the nozzle. Similarly the high-voltage generator can be built right into the nozzle.

It is also within the scope of this invention to aspirate air and airborne particles at the nozzle, mix fresh particles with the aspirated particles, filter the aspirated and admixed particles, and conduct the mixture of fresh and aspirated particles to the nozzle. Such a process does not affect the granulometry of the particles and does not separate them into separate grades, particularly fines. Thus the filtration improves the economic yield of the process by allowing recycling of all of the powder The nozzle according to this invention is a two-part body forming respective passages formed in the nozzle and opening oppositely into the ends of the groove thereof. In addition the nozzle has a longitudinal end from which one of the passages extends longitudinally straight to the groove. The other passage is J-shaped and extends from the same one longitudinal end as the other passage. Such construction is very compact and allows the can sleeves to be fitted over and removed from the nozzle rapidly.

In accordance with the invention the means for imparting the predetermined potential level to the sleeve surrounding the nozzle is a grounded conveyor engaging the sleeve.

DESCRIPTION OF THE DRAWING

The above and other features and advantages will become more readily apparent from the following, reference being made to the accompanying drawing in which.

SPECIFIC DESCRIPTION

Figure 1:
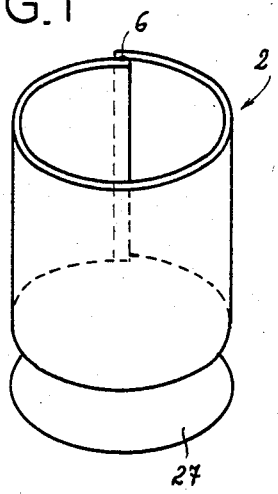
FIG. 1 is a perspective view of a sleeve and end cap of a can.
Figure 2:
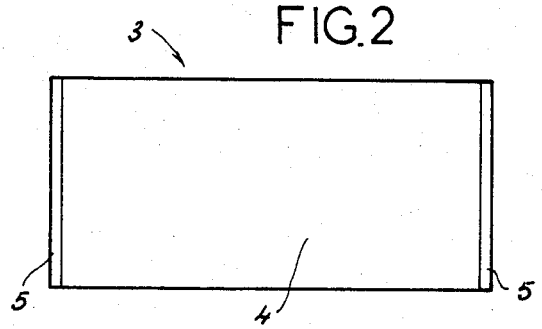
FIG. 2 is a top view of a blank from which the sleeve is made.

As seen in FIGS. 1 and 2 a standard three-part can is made from a rectangular blank 3 that is provided on one face with a coating 4 of varnish or similar organic material except at two end strips 5. This blank 3 is then rolled up into a sleeve 2 and the uncoated end strips 5 are overlapped at 6 and welded together. Eventually end caps 27 are secured in the ends of this sleeve 2, after of course putting in the contents of the package.

Figure 3:
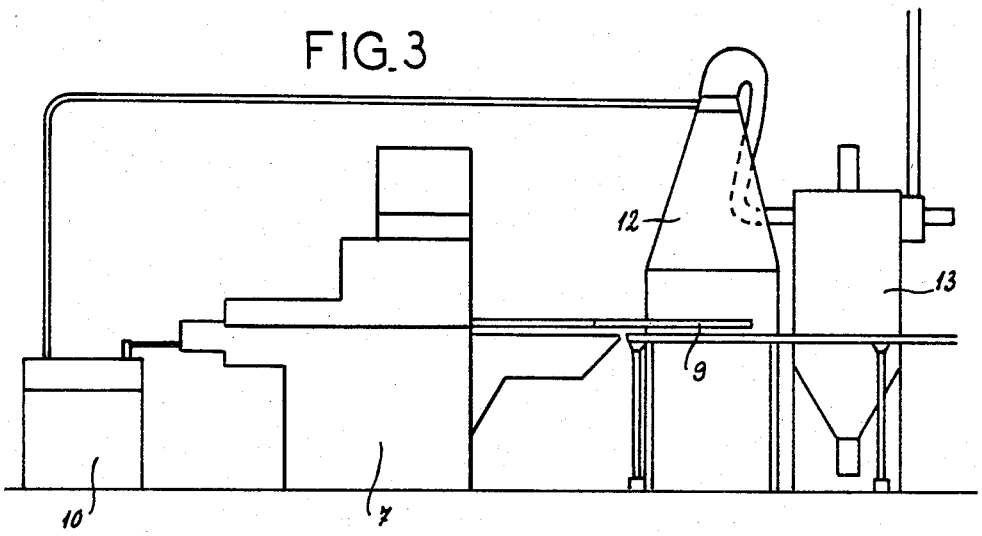
FIG. 3 is a small-scale side view of the apparatus according to this invention.
Figure 4:
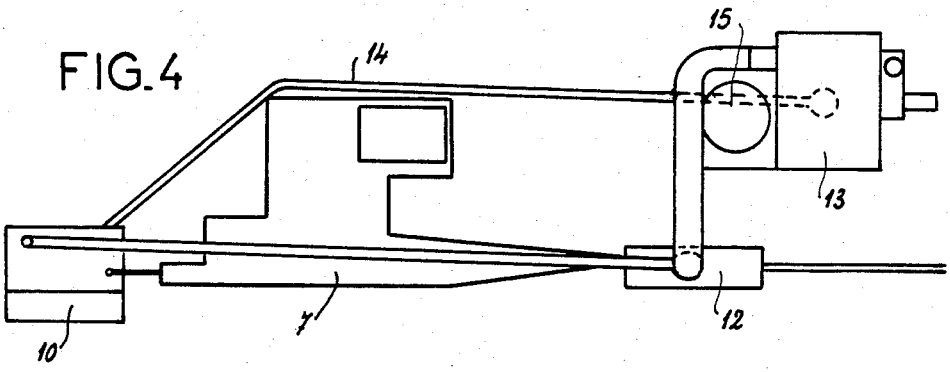
FIG. 4 is a top view of the apparatus of FIG. 3.
Figure 6:
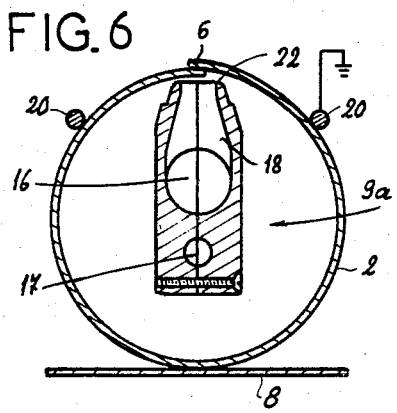
FIGS. 6 and 7 are sections taken respectively along lines VI—VI and VII—VII of FIG. 5.
Figure 7:
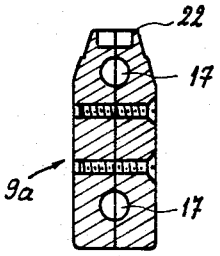

The welded sleeves 2 are formed from the blanks 3 in a machine shown at 7 in FIGS. 3 and 4. Then the seams 6 are coated by a nozzle 9 while supported on a magnetic conveyor belt 8 (FIG. 6) and pressed upward against grounded horizontal guide rods 20. A hood 12 over the nozzle 9 aspirates excess powder and conducts it to a cyclone-type filter 13 to which fresh powder is fed from a supply 15. The fresh powder as well as the recycled powder is conducted via a pipe 14 to the device 10 which supplies it with air under pressure to the nozzle 9. Replenishing the powder upstream of the filter 13 ensures good mixing with the recycled powder.

Figure 5:
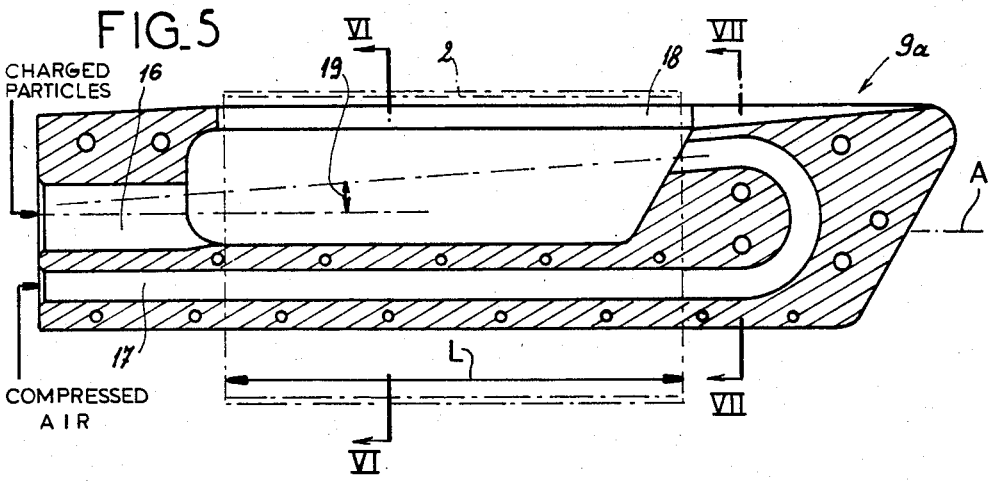
FIG. 5 is a larger-scale axial section through the nozzle of the apparatus of this invention.

As shown in FIG. 5 a nozzle 9*a* extends along the axis A of the sleeve 2 and is formed with a radially open groove 18 that is delimited by two brushes or lips 22 and that opens upward at the seam 6 of the sleeve 2 confined between the guide rods 20 and the conveyor 8. A large-diameter bore 16 opens parallel to the axis A into one end of this groove 18 and is supplied with charged particles from the device 10, A smaller-diameter J-shaped passage opens generally axially into the opposite end of this groove 18 in a direction forming an angle 19 with the passage 16. Thus the stream of charged particles and will be deflected radially outward onto the seam 6 to stick to the uncoated grounded inner surface of the sleeve 2 at the seam 6.

Figure 8:
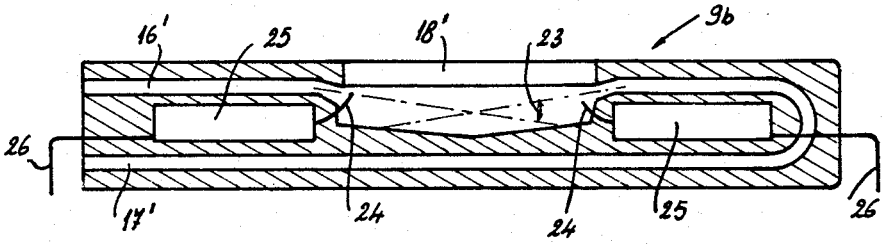
FIG. 8 is a view like FIG. 5 but through another nozzle according to this invention.

FIG. 8 shows another nozzle where two small-diameter passages 16′ and 17′ that both are fed a mixture of particles and compressed air open into a groove 18′ in directions forming an angle 23 with each other This angle 23 is twice the angle 19 and ensures good mixing of the particles and perfectly radial ejection of them. A power supply whose output line is shown at 26 is connected to two cascades 25 having respective charging electrodes 24 positioned in front of the open ends of the passages 16′ and 17′. In this arrangement the particles of the one stream are charged by the respective electrodes 24 to be positive and the other stream is negative. All particles are therefore attracted to the grounded workpiece.

In both arrangements the compressed air is fed in in a direction forming an acute angle with the sleeve axis and with the surface being coated. This angle ensures better outward deflection of the resultant combined stream. The composite air-driven/electrostatic system of this invention can be counted on to work with great uniformity. At the same time the coating is thick and the use of solvents is avoided.

We claim:

1. A method of striping a surface, the method comprising the steps of:

positioning a nozzle having an elongated groove adjacent the surface with the groove opening immediately along the region of the surface to be striped;

imparting to the surface surrounding the nozzle a predetermined potential level;

introducing a stream of dry particles into at least one end of the groove in a predetermined direction at least generally parallel to the groove and to the region to be striped;

charging the particles relative to the potential level of the surface being such that the particles are attracted to the surface; and introducing a stream of air under pressure into the end of the groove opposite the one end of the groove in a direction generally opposite to the predetermined direction and thereby deflecting the particle stream transversely from the groove toward the region.

2. The electrostatic striping method defined in claim 1 wherein the region is a seam of a sleeve which is to be made into a three-part can and which forms the surface.

3. The electrostatic striping method defined in claim 1 wherein particles mixed with air under pressure are injected as opposite streams into the ends of the groove in opposite directions.

4. The electrostatic striping method defined in claim 1 wherein substantially only particles are injected into the one end of the groove and substantially only air under pressure into the opposite end of the groove.

5. The electrostatic striping method defined in claim 1 wherein the particles are injected into the one end of groove substantially parallel to the groove and to the region and the air under pressure is introduced into the opposite end of the groove at a slight acute angle to the groove and to the region.

6. The electrostatic striping method defined in claim 1 wherein the surface is imparted a predetermined potential level by grounding it.

7. The electrostatic striping method defined in claim 6 wherein particles and compressed air are introduced mixed together at both ends of the groove as opposite streams and the particles of one of the streams are charged positive and the particles of the other stream negative.

8. The electrostatic striping method defined in claim 1, further comprising the steps of aspirating air and airborne particles at the nozzle;

mixing fresh particles with the aspirated particles;

filtering the aspirated and admixed particles; and conducting the mixture of fresh and aspirated particles to the nozzle.

9. An apparatus for striping a surface, the apparatus comprising:

a nozzle having an elongated groove and positionable adjacent the surface with the groove opening immediately at the region of the surface to be striped;

means for imparting to the surface surrounding the nozzle a predetermined potential level;

means for introducing a stream of dry particles into at least one end of the groove in a direction at least generally parallel to the groove and to the region to be striped;

means for charging the particles relative to the potential level of the surface such that the particles are attracted to the surface; and means for introducing a stream of air under pressure into the opposite end of the groove in generally the opposite direction and thereby deflecting the particle stream transversely from the groove toward the region.

10. The electrostatic striping apparatus defined in claim 9 wherein the introducing means are respective passages formed in the nozzle and opening oppositely into the ends of the groove thereof.

11. The electrostatic striping apparatus defined in claim 10 wherein the nozzle has a longitudinal end from which one of the passages extends longitudinally straight to the groove, the other passage being J-shaped and extending from the same one longitudinal end as the one passage.

12. The electrostatic striping apparatus defined in claim 9 wherein the means for imparting the predetermined potential level to the surface surrounding the nozzle is a grounded conveyor engaging the surface.

13. The electrostatic striping apparatus defined in claim 9 wherein the groove is longer than the region and extends longitudinally therebeyond.

14. The electrostatic striping apparatus defined in claim 9, further comprising means for aspirating air and airborne particles at the nozzle;

means for mixing fresh particles with the aspirated particles;

means for filtering the aspirated and admixed particles; and means for conducting the mixture of fresh and aspirated particles to the nozzle.

* * * * *